US010406670B2

(12) United States Patent
Roehm et al.

(10) Patent No.: US 10,406,670 B2
(45) Date of Patent: Sep. 10, 2019

(54) SYSTEM HAVING AN ADD-ON HANDLE AND A HAND-HELD POWER TOOL

(71) Applicant: Robert Bosch GmbH, Stuttgart (DE)

(72) Inventors: Heiko Roehm, Stuttgart (DE); Tobias Herr, Stuttgart (DE); Ralf Windsheimer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 566 days.

(21) Appl. No.: 14/085,123

(22) Filed: Nov. 20, 2013

(65) Prior Publication Data

US 2014/0144656 A1 May 29, 2014

(30) Foreign Application Priority Data

Nov. 27, 2012 (DE) ..... 10 2012 221 631
Jun. 10, 2013 (DE) ..... 10 2013 210 749

(51) Int. Cl.
*B25D 17/04* (2006.01)
*B25F 5/02* (2006.01)

(52) U.S. Cl.
CPC ..... *B25F 5/02* (2013.01); *B25F 5/026* (2013.01)

(58) Field of Classification Search
CPC ..... B25F 5/026; B25D 17/043; B25D 17/04; Y10T 16/469; Y10T 16/4713; Y10T 16/498; Y10T 16/48; Y10T 16/476
USPC .... 173/46, 170, 162.1, 162.2; 16/110.1, 421
See application file for complete search history.

(56) References Cited

U.S. PATENT DOCUMENTS 4,585,077 A * 4/1986 Bergler ..... B23B 31/1238 173/13
4,824,298 A * 4/1989 Lippacher ..... B23B 31/008 173/48
4,858,077 A 8/1989 Shinohara et al.
5,607,266 A * 3/1997 Anderson ..... B23B 51/0473 408/124
5,671,815 A * 9/1997 Kabatnik ..... B25F 5/02 173/217
5,881,823 A * 3/1999 Kabatnik ..... B25D 17/00 173/217
7,008,151 B2 * 3/2006 Yaksich ..... B23B 31/1238 279/62
2003/0116335 A1 * 6/2003 Milbourne ..... B25B 21/00 173/170
2005/0087353 A1 * 4/2005 Oki ..... B25D 17/043 173/162.2

(Continued)

FOREIGN PATENT DOCUMENTS

CN 1500593 A 6/2004
CN 1533867 A 10/2004
CN 1607076 A 4/2005

*Primary Examiner* — Andrew M Tecco
*Assistant Examiner* — Eyamindae C Jallow
(74) *Attorney, Agent, or Firm* — Norton Rose Fulbright US LLP; Gerard Messina

(57) ABSTRACT

A system includes: an add-on handle; and a hand-held power tool which includes a clutch setting ring, a chuck with clamping jaws and a handle fastening arrangement which is situated axially between a section of the chuck and the clutch setting ring. In at least one operating state the add-on handle fastened to the handle fastening arrangement and the clamping jaws of the chuck are situated in at least one plane which is oriented perpendicularly to a rotation axis of the chuck.

10 Claims, 2 Drawing Sheets

(56) References Cited

U.S. PATENT DOCUMENTS

2005/0257945 A1* 11/2005 Justis ..... B25F 5/02
173/217
2011/0005355 A1* 1/2011 Brennenstuhl ..... B25F 5/026
81/57.38

* cited by examiner

SYSTEM HAVING AN ADD-ON HANDLE AND A HAND-HELD POWER TOOL

BACKGROUND OF THE INVENTION

The present invention is directed to a system having an add-on handle and a hand-held power tool which includes a clutch setting ring, a chuck with clamping jaws and a handle fastening arrangement situated axially between a section of the chuck and the clutch setting ring.

BRIEF SUMMARY OF THE INVENTION

The present invention provides that in at least one operating state the add-on handle fastened to the handle fastening means and the clamping jaws of the chuck are situated, at least partly, in at least one plane oriented perpendicularly to a rotation axis of the chuck. "Add-on handle" is intended in particular to mean a means provided to be grasped by an operator and which is spaced apart from a main handle of the hand-held power tool. Preferably, in a fastened operating state, the add-on handle is situated in the main operating direction of the main handle. Preferably the add-on handle may in particular be fastened by an operator to the handle fastening means for releasable detachment without tools. In particular, a gripping area of the add-on handle extends at least essentially perpendicularly to a rotation axis of the chuck.

"Provided" is intended in particular to mean specifically designed and/or equipped. "Hand-held power tool" is intended in particular to mean a hand-held power tool, in particular a hand-held power tool for machining workpieces which appears useful to those skilled in the art, preferably, however, a screwdriver, an impact wrench, a drill, an impact drill, a drill hammer and/or a percussion hammer and/or particularly preferred, a combi drill. "Clutch setting ring" is intended to mean in particular an operating means which is provided for changing the torque clutch setting when activated by an operator. Preferably, the handle fastening means exerts an axial fastening force on the clutch setting ring in at least one operating state. In particular, "axially between" is intended to mean that the handle fastening means is situated at least partly between two planes which are oriented perpendicularly to the rotation axis of the chuck, one of which intersects the chuck and one the clutch setting ring.

A "chuck" is intended in particular to mean a device which is provided for changeably attaching an insertion tool by an operator. The chuck is preferably designed as a drill chuck which appears useful to those skilled in the art. A "clamping jaw" is intended in particular to mean a component of the chuck which is movably mounted for attaching the insertion tool. Preferably, the clamping jaw exerts a force on the insertion tool for the purpose of attaching the latter. The clamping jaw advantageously exerts an attachment force directly on the insertion tool in at least one operating state. Particularly preferably, multiple clamping jaws of the chuck secure the insertion tool in a force-fitting manner. In particular, the clamping jaws are translationally movable in the chuck, in particular relative to a tool spindle of the hand-held power tool. A "handle fastening means" is intended in particular to mean a means provided to be coupled to an add-on handle. Preferably, the handle fastening means is provided to be connected by an operator to the add-on handle for releasable detachment without tools. In particular, the handle attachment means is provided to be connected to a standardized add-on handle.

The phrase "situated at least partly in at least one plane" is intended in particular to mean that in at least one operational state, at least one single plane oriented perpendicularly to the rotation axis of the chuck intersects the add-on handle and the clamping jaws. In this context, "oriented perpendicularly" is intended in particular to mean that a normal of the plane is oriented in parallel to the rotation axis of the chuck. A "rotation axis of the chuck" is intended in particular to mean an axis about which the chuck is rotationally driven during an operation. A particularly short overall length may be achieved by the design of the add-on handle and the hand-held power tool according to the present invention.

In one further embodiment it is provided that the add-on handle attached to the handle fastening means encloses the clamping jaws at least in part, making it possible to advantageously fasten the add-on handle in a simple manner. The phrase "enclose at least in part" is intended in particular to mean that the handle fastening means surrounds at least a section of the chuck in at least the plane of more than 180 degrees, advantageously more than 270 degrees, particularly advantageously more than 360 degrees. Preferably, the plane is oriented perpendicularly to the rotation axis of the chuck.

It is further provided that the add-on handle fastened to the handle fastening means and the clamping jaws of the chuck are situated at least partly in the plane when the clamping jaws are fully opened, thereby allowing the add-on handle with a short overall length to be advantageously positioned. The phrase "when the clamping jaws are fully opened" is intended in particular to mean an arrangement of the clamping jaws in which a greatest possible area for fastening an insertion tool is situated between the clamping jaws. Preferably, the clamping jaws when in the opened operating state are situated opposite the main operating direction of the hand-held power tool.

It is further provided that the handle fastening means has an annular clamping section with the aid of which the add-on handle may be secured to the handle fastening means in a simple manner in varying orientations about the rotation axis of the chuck. An "annular clamping section" is intended in particular to mean a section which has a cylinder barrel-shaped outer face and which is provided to establish a force-fitting connection with the add-on handle.

In addition, it is provided that the handle fastening means has a diameter of between 35 mm and 50 mm, advantageously between 40 mm and 46 mm, by which a standardized add-on handle may be fastened. A "diameter" is intended in particular to mean a preferably maximum dimension in the plane perpendicular to the rotation axis of the chuck.

In one advantageous embodiment of the present invention it is provided that the handle fastening means is made at least essentially of an electrically conductive material, making possible a particularly simple and stable design. An "electrically conductive material" is intended in particular to mean a material which has a specific resistance of less than 100 $\Omega mm^2/m$. For example, the handle fastening means could be made of aluminum or steel. "At least essentially" is intended in particular to mean that the handle fastening means is made of more than 75% electrically conductive material.

In one further embodiment it is provided that the hand-held power tool includes an insulation unit which is provided to secure the handle fastening means so that it is electrically insulated from the tool spindle, whereby a stable fastening option for an add-on handle situated advantageously far forward is provided, in which the risk of an electric shock is minimized when drilling into a power line. An "insulation unit" is intended in particular to mean a unit which has a resistance of greater than 1 kΩ, advantageously greater than 100 kΩ, particularly advantageously more than 1 MΩ between at least two, advantageously three, fastening locations. Preferably, one of the fastening locations of the insulation unit exerts a force on the handle fastening means in at least one operating state. Advantageously, one of the fastening locations of the insulation unit exerts a force on the tool spindle in at least one operating state. Preferably, one of the fastening locations of the insulation unit exerts a force on the gear unit housing of the hand-held power tool in at least one operating state. A "tool spindle" is intended in particular to mean a means which is provided to secure the chuck. Preferably, the tool spindle is rotatably mounted. "Attach so that it is electrically insulated" is intended in particular to mean that the insulation unit arranges the tool spindle relative to the handle fastening means and thereby prevents a current flow dangerous to humans at least up to an applied low voltage supply voltage, in particular 230 volts.

Moreover, it is provided that the hand-held power tool includes a gear unit housing to which the handle fastening means is secured, thereby providing a particularly simple and space-saving design. A "gear unit housing" is intended in particular to mean a means which is provided to protect a gear unit from penetration, at least from dust. Preferably at least one gear of the gear unit, advantageously all gears of the gear unit, are mounted in the gear unit housing.

It is further provided that the gear unit housing and the insulation unit are designed at least partly as a single piece, thereby enabling production at low cost. "Single piece" is intended, in particular, to mean integrally joined, as produced from a mold and/or as produced by a single or multi-component injection molding process. Preferably, at least one single-piece section of the insulation unit and the gear unit housing is made from an insulating material. For example, the gear unit housing could be made at least in part of PA6 plastic or PA66 plastic.

In addition, it is provided that the hand-held power tool includes a bearing device, on which the tool spindle is rotatably mounted in the gear unit housing, whereby a complex design for securing the bearing device may be dispensed with. A "bearing device" is intended in particular to mean a device which is provided to exert at least radial and advantageously axial bearing forces directly on the tool spindle.

It is further provided that the handle fastening means indirectly fastens the bearing device axially, thereby eliminating the need for a separate bearing attachment. In addition, tensile forces may be reliably transferred onto the tool spindle. "Indirectly fastens" is intended in particular to mean that the handle fastening means exerts a fastening force on the bearing device with the aid of an additional means. In this context, "axial" is intended in particular to mean that the handle fastening means exerts a fastening force essentially in parallel to the rotation axis of the chuck.

In one advantageous embodiment of the present invention, the insulation unit includes an insulant situated between the handle fastening means and the bearing device, thereby preventing voltage from being transmitted from the tool spindle to the handle fastening means with the aid of the bearing device. An "insulant" is intended in particular to mean a means provided to create an insulation between two electrically conductive sections. Preferably, the insulant has at least in part a specific resistance greater than 100 Ω $mm^2/m$. For example, the insulant could be made of a plastic, an elastomer or rubber. In this context, "between" is intended in particular to mean that the insulant is situated along a straight line which, on one side of the insulant, intersects the handle fastening means, and on the other side of the insulant intersects the bearing device.

The hand-held power tool according to the present invention is not intended to be limited to the application and specific embodiment described above. In particular, the hand-held power tool according to the present invention may include a number of individual elements, components and units which differs from the number cited herein for performing a functionality described herein.

DETAILED DESCRIPTION OF THE INVENTION

Figure 1:
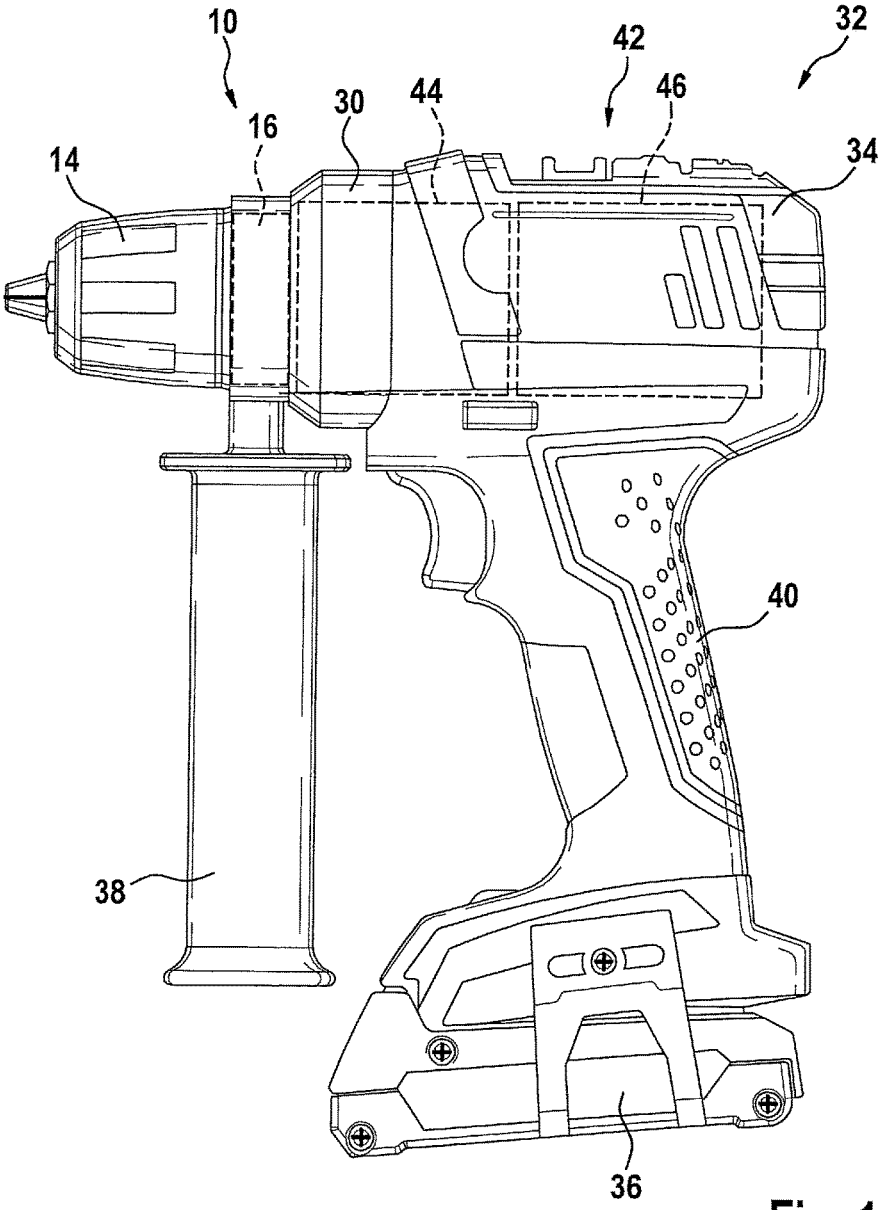
FIG. 1 shows a system having an add-on handle and a hand-held power tool.

FIG. 1 shows a system 10 having an add-on handle 38 and a hand-held power tool 32. Hand-held power tool 32 includes a chuck 14, a handle fastening means 16, a clutch setting ring 30, a hand tool housing 34, a hand tool rechargeable battery 36, add-on handle 38, a gear unit 44 and a drive unit 46. Hand tool rechargeable battery 36 supplies drive unit 46 with electrical energy during operation. Hand tool rechargeable battery 36 is connected by an operator to hand tool housing 34 for releasable detachment therefrom without tools. Hand tool housing 34 is designed in the shape of a pistol. It includes a main handle 40 and a drive housing section 42. Drive housing section 42 has ventilation slots. A gripping section of add-on handle 38 is formed from an electrically insulating plastic. Add-on handle 38 is oriented essentially perpendicularly to an axial direction of chuck 14.

Figure 2:
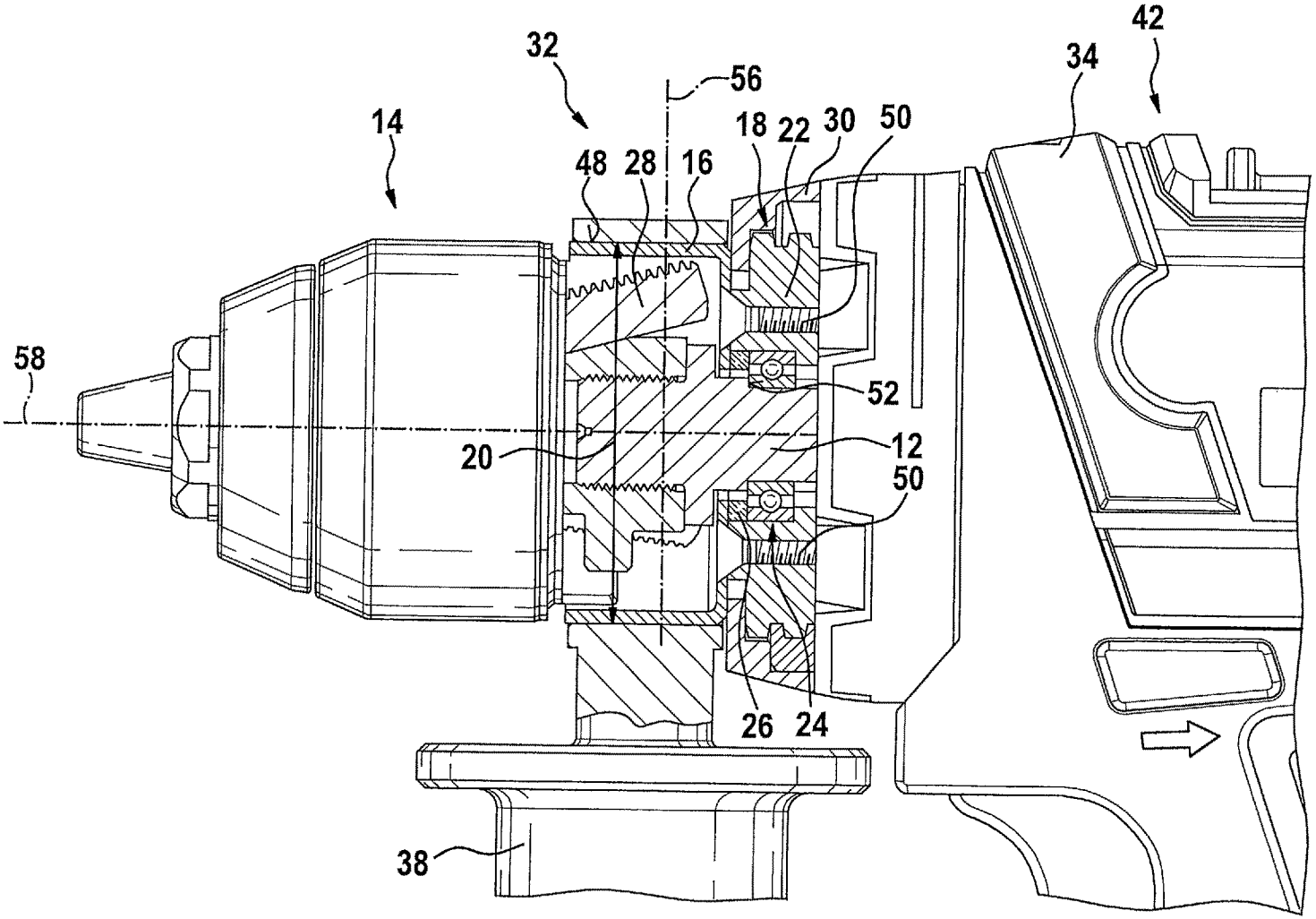
FIG. 2 shows a partial section of the hand-held power tool and the add-on handle from FIG. 1.

As shown in FIG. 2, hand-held power tool 32 includes a tool spindle 12, an insulation unit 18 and a bearing device 24. Drive housing section 42 encloses drive unit 46. During an operation, drive unit 46 rotationally drives tool spindle 12 with the aid of gear unit 44. Gear unit 44 is designed to provide at least two gear ratios and two different directions of rotation. Gear unit 44 includes a torque clutch not shown in further detail, which is provided to functionally separate tool spindle 12 from drive unit 46 when a torque, which is adjustable with the aid of clutch setting ring 30, is exceeded. The torque clutch has a drill setting in which tool spindle 12 and drive unit 46 are permanently connected. Tool spindle 12 and chuck 14 are detachably connected. In this embodiment, tool spindle 12 and chuck 14 are screwed together. Chuck 14 has three clamping jaws 28.

Clutch setting ring 30 is situated axially between drive housing section 42 and handle fastening means 16. Clutch setting ring 30 is rotatably mounted about an axis which corresponds to a rotation axis 58 of chuck 14. Clutch setting ring 30 is rotatably mounted on a gear unit housing 22 of gear unit 44. Handle fastening means 16 secures clutch setting ring 30 in the axial direction in at least one operating state. Clutch setting ring 30 encloses a part of gear unit 44.

Handle fastening means 16 is situated axially between a section of chuck 14 and clutch setting ring 30. Handle fastening means 16 includes an annular clamping section. Add-on handle 38 fastened to handle fastening means 16 and clamping jaws 28 of chuck 14 are, at least when clamping jaws 28 are fully opened, partially situated in at least one plane 56 oriented perpendicularly to rotation axis 58 of chuck 14. Handle fastening means 16 and add-on handle 38 enclose a section of chuck 14; specifically, handle fastening means 16 and add-on handle 38 partially enclose three clamping jaws 28 of chuck 14, at least when chuck 14 is fully opened. When chuck 14 is fully opened, it is able to accommodate insertion tools having a shaft diameter of at least 10 mm, advantageously 13 mm.

A fastening surface 48 for fastening add-on handle 38 is designed as a cylinder barrel-shaped outer face of handle fastening means 16. In a fastened operating state, add-on handle 38 encloses handle fastening means 16. In this state, add-on handle 38 is frictionally engaged in the axial and tangential direction of handle fastening means 16. Alternatively, or in addition, add-on handle 38 and handle fastening means 16 could be connected in a form-locking manner. Add-on handle 38 may be fastened to handle fastening means 16 in different orientations about the axial direction. Handle fastening means 16 has a maximum diameter 20 of 43 mm perpendicular to the axial direction. Chuck 14 has at least a diameter perpendicular to the axial direction which is greater than a maximum inner diameter of handle fastening means 16. The diameter of chuck 14 perpendicular to the axial direction is smaller than the maximum diameter 20 of handle fastening means 16. Handle fastening means 16 is made of an electrically conductive material.

Handle fastening means 16 is fastened to gear unit housing 22 of gear unit 44. Handle fastening means 16 and gear unit housing 22 are connected to each other by screws 50. Gear unit housing 22 and insulation unit 18 are formed as a single piece. Gear unit housing 22 is made of an electrically insulating material. Thus, insulation unit 18 secures handle fastening means 16 so that it is electrically insulated from tool spindle 12.

Tool spindle 12 is rotatably mounted on bearing device 24 in gear unit housing 22. Bearing device 24 is designed as a ball bearing. Bearing device 24 is provided for the purpose of transmitting axial forces. Tool spindle 12 has an axial stop 52 which abuts bearing device 24 on a side of bearing device 24 facing chuck 14. Handle fastening means 16 secures bearing device 24 indirectly in the axial direction. Insulation unit 18 includes an insulant 26 which is situated between handle fastening means 16 and bearing device 24. Insulant 26 transmits a fastening force from handle fastening means 16 to bearing device 24 in at least one operating state. Hand-held power tool 32 includes a second bearing device not further described which supports tool spindle 12 on a side facing away from chuck 14.

What is claimed is:

1. A power tool system, comprising:

an add-on handle; and a hand-held power tool which includes a clutch setting ring, a chuck with clamping jaws, and a handle fastening arrangement situated axially between a section of the chuck and the clutch setting ring;

wherein in at least one operating state (i) the add-on handle is fastened to the handle fastening arrangement, and (ii) the clamping jaws of the chuck and the add-on handle fastened to the handle fastening arrangement are situated in at least one plane which is oriented perpendicularly to a rotation axis of the chuck, wherein the at least one plane intersects the add-on handle and the clamping jaws in the at least one operating state, wherein the hand-held power tool includes a gear unit housing to which the handle fastening arrangement is secured, wherein the hand-held power tool includes a bearing device on which a tool spindle is rotatably mounted in the gear unit housing, wherein the handle fastening arrangement indirectly fastens the bearing device axially.

2. The system as recited in claim 1, wherein the add-on handle fastened to the handle fastening arrangement encloses the clamping jaws of the chuck.

3. The system as recited in claim 2, wherein the clamping jaws of the chuck and the add-on handle fastened to the handle fastening arrangement are situated in the at least one plane which is oriented perpendicularly to a rotation axis of the chuck, at least when the clamping jaws are fully opened.

4. The system as recited in claim 2, wherein the handle fastening arrangement includes an annular clamping section.

5. The system as recited in claim 4, wherein the handle fastening arrangement has a diameter between 35 mm and 50 mm.

6. The system as recited in claim 4, wherein the handle fastening arrangement is made of more than 75% of an electrically conductive material.

7. The system as recited in claim 4, wherein the hand-held power tool includes an insulation unit which secures the handle fastening arrangement such that the handle fastening arrangement is electrically insulated from a tool spindle of the hand-held power tool.

8. The system as recited in claim 1, wherein the handle fastening arrangement is secured to the gear unit housing by screws.

9. The system as recited in claim 1, wherein the gear unit housing and the insulation unit are at least partially embodied in one piece.

10. The system as recited in claim 1, wherein the clutch setting ring is rotatably mounted on the gear unit housing and encloses a part of a gear unit disposed in the gear unit housing.

* * * * *